United States Patent [19]

Frechin

[11] 4,338,733

[45] Jul. 13, 1982

[54] SAFETY DEVICE FOR CRAMPONS, AND CRAMPONS EQUIPPED THEREWITH

[76] Inventor: Jean-Paul Frechin, 215 Chemin de la Croix des Pecles, 74400 Chamonix, France

[21] Appl. No.: 149,554

[22] Filed: May 13, 1980

[30] Foreign Application Priority Data

May 14, 1979 [FR] France ..... 79/12382

[51] Int. Cl.[3] ..... A43B 1/10; A43B 3/10; A43B 5/00

[52] U.S. Cl. ..... 36/7.3; 36/7.6; 36/135

[58] Field of Search ..... 36/7.6, 135, 62, 7.3

[56] References Cited

U.S. PATENT DOCUMENTS 3,486,248 12/1969 Olson et al. ..... 36/7.3
3,559,309 2/1971 Taylor ..... 36/7.3
3,763,578 10/1973 Chadwell ..... 36/7.3

FOREIGN PATENT DOCUMENTS 2285093 9/1974 France ..... 36/7.6

*Primary Examiner*—Patrick D. Lawson
*Attorney, Agent, or Firm*—Stevens, Davis, Miller & Mosher

[57] ABSTRACT

Safety device for crampons which permits a mountain climber to travel without danger on snow-covered slopes by preventing snow from accumulating below his crampons, would cause him to slip and fall. It comprises a sheet of deformable material which placed below the frame of the crampon and fastened to it by a plurality of side hooks and end hooks. The user can install it very easily. The invention may be used to equip all types of crampons and thus promote the safety of mountain climbers.

12 Claims, 11 Drawing Figures

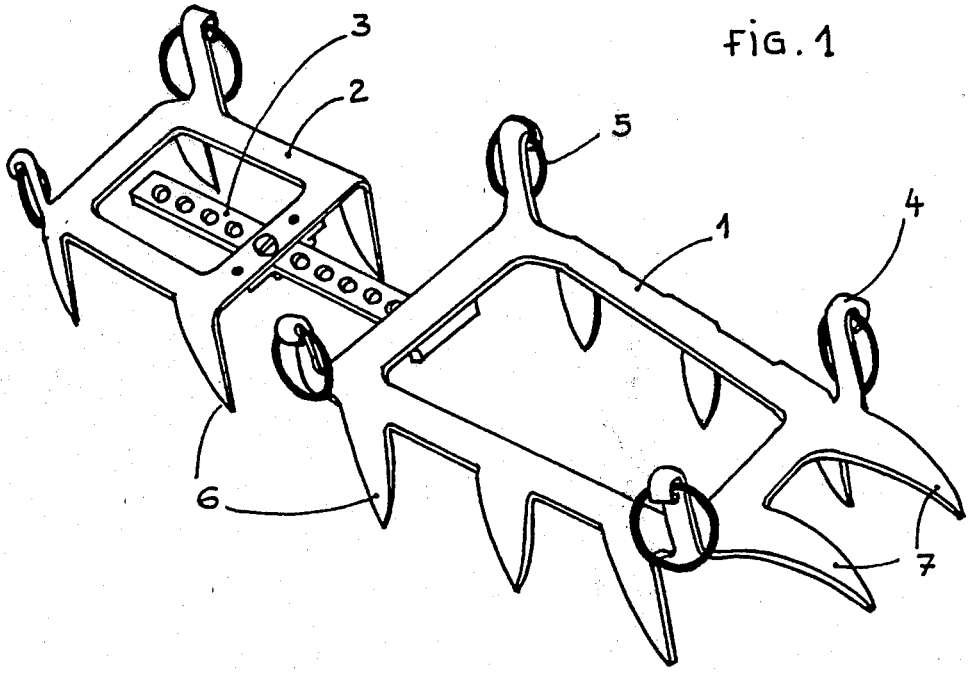
FIG. 1
FIG. 2
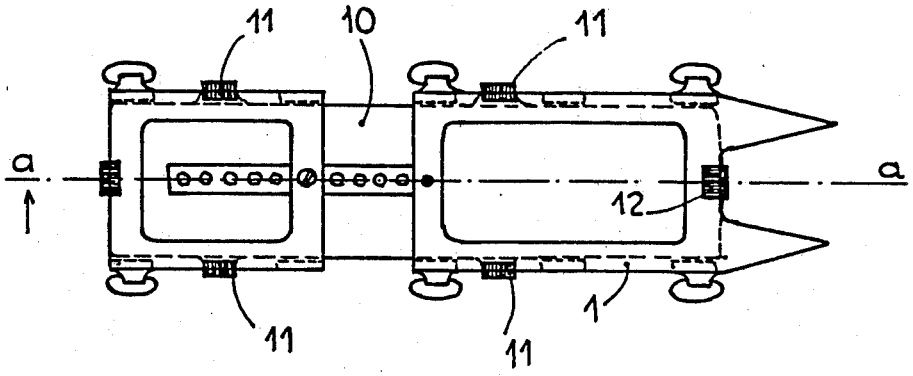
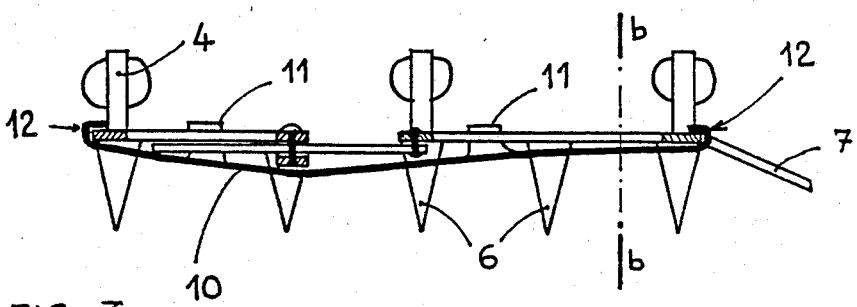
FIG. 3

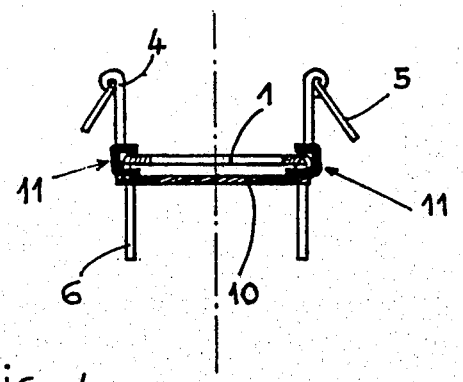
FIG. 4
FIG. 5
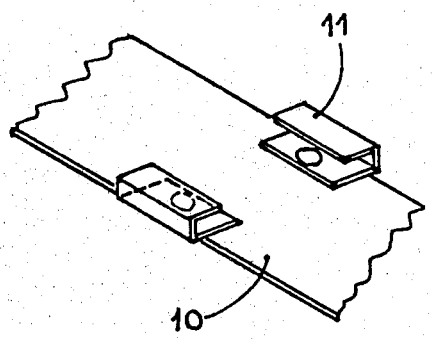
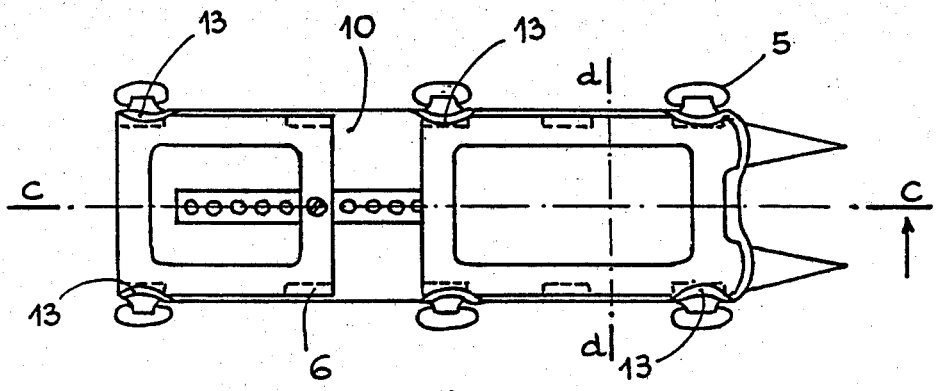
FIG. 6
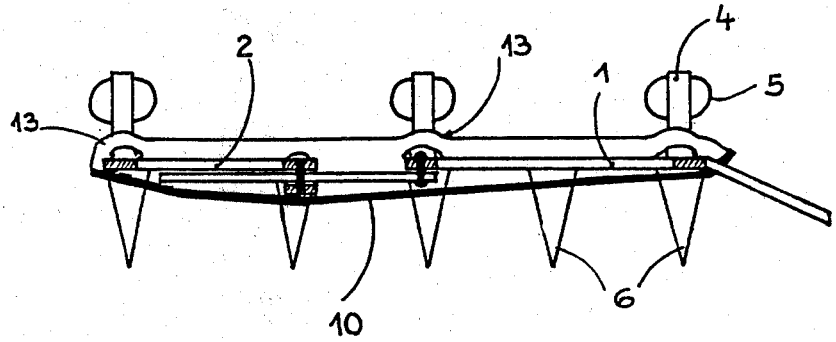
FIG. 7

FIG. 8
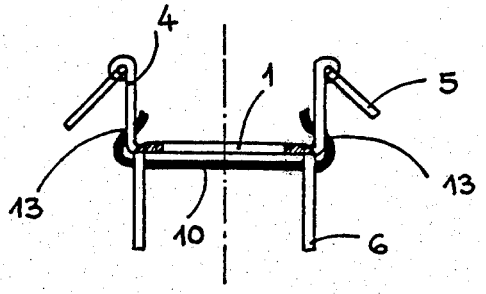
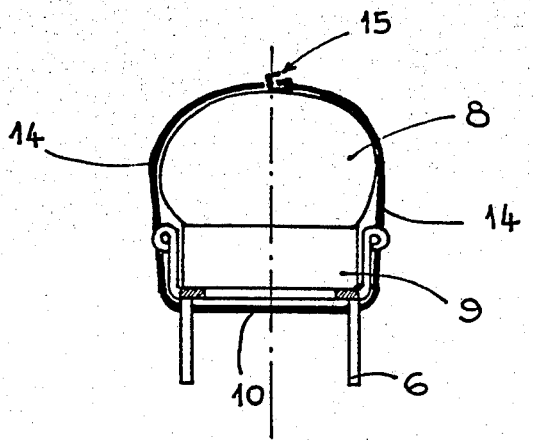
FIG. 9
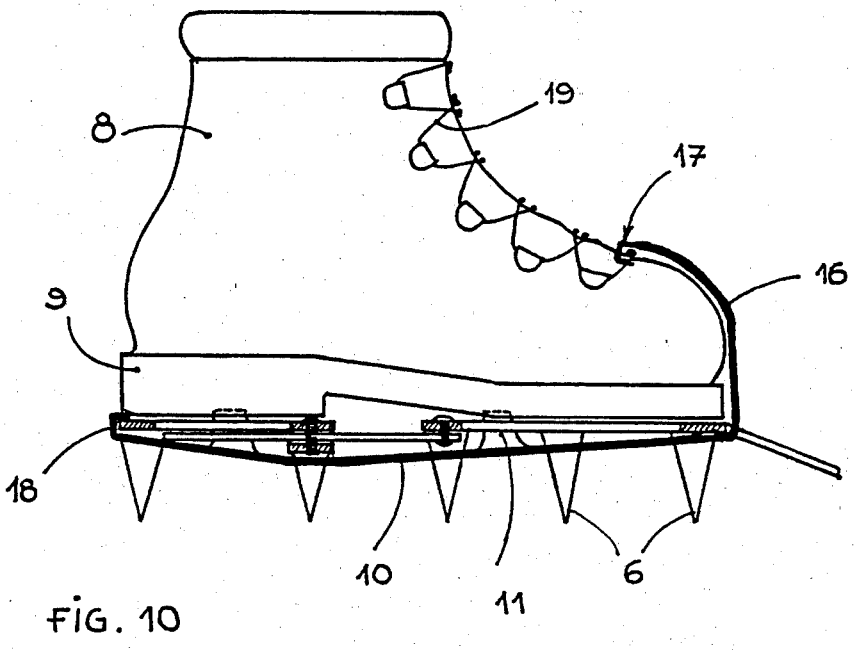
FIG. 10

SAFETY DEVICE FOR CRAMPONS, AND CRAMPONS EQUIPPED THEREWITH

BACKGROUND OF THE INVENTION

This invention relates to the equipment used by mountain climbers and more particularly crampons which, when placed under climbing boots, are used to move over snow-covered slopes, or walls covered with snow and ice.

More particularly, it relates to a safety device which can be applied to all crampons presently on the market, as well as a new type of crampon equipped with such device.

In general, the existing crampons are formed essentially of a metal frame, formed of two individual frames, one for the front of the boot and the other for the heel, connected together by at least one system for length adjustment which makes it possible to fit the crampon to the toe of the boot. Each of these individual frames is provided with attachment lugs which make it possible to fasten the crampons to the boots by means of belts or straps, and has, at its bottom, a variable number of spikes which implant themselves in the snow or ice upon the advance of the mountain climber.

These crampons which constitute the prior art have a very serious defect during travel over snow, both on ascent and especially on descent, or more particularly when the snow has been softened by the sun, as is very frequently the case. It is a fact that snow has a tendency to accumulate below the crampon in the space between the spikes, filling this space more or less rapidly, thus preventing the spikes from playing their role, which then promotes sliding and therefore the fall of the mountain climber. This phenomenon, which is greatly feared by mountain climbers, takes place without their knowledge since it takes place under the soles of their boots. It is responsible for most of the climbing accidents which take place on snow and is therefore directly one of the main causes for fatal mountain climbing accidents.

At present there is no way of alleviating this very serious drawback, since none of the attempts made by the manufacturers, such as, for instance, different shapes of the teeth, coating with a silicone paint, etc., have given fully satisfactory results.

The failure of the prior solutions proposed to solve this problem is furthermore entirely understandable if one studies the reasons which cause the snow to fill the space between the spikes below the crampon, namely:

on the one hand, there is a mechanical hooking of the snow on the relief designs in the sole of the climbing boot and on the various parts of the length adjustment system which form so many points for hooking, as well as the fact of the packing of the snow between the spikes which, due to their distribution, thus define a space which forms, so to speak, a mold;

in addition to this purely mechanical hooking there is a thermal bonding coming from the fact that the metal parts of the crampon under the foot of the mountain climber form a cold assembly to which the snow easily adheres;

and, finally, the snow is compressed forcefully in the space present between the spikes by the weight of the climber so that during each step it is subjected to vertical pressure and is packed even more if it has been softened by the sun and encounters a hard surface consisting of the sole of the boot and the frames of the crampon.

BRIEF SUMMARY OF THE INVENTION

The present invention is directed at avoiding these very serious defects in a simple, very effective manner. It concerns a safety device which avoids having the snow fill the space between the spikes, this device being formed essentially of a sheet placed under the frame of the crampons and facing the snow, this sheet being adapted, either by its own nature or due to various suitable means of attachment which will be described in further detail below, to deform or move slightly in elastic fashion in all directions (length, width and thickness) when the user walks.

The sheet in accordance with the invention, when placed below the frame of the crampon, makes it possible to avoid mechanical hooking upon the sole and on the adjustment system. Forming a screen between the metal parts of the crampon in contact with the sole and the snow, it avoids thermal hooking. As it offers a movable seat deformable in all directions (length, width and thickness) to the snow, which tends to pack within the space between the spikes, it furthermore avoids vertical packing of the snow and this has the result of eliminating mechanical hooking between the spikes.

Finally, the presence of the sheet in accordance with the invention also provides heat insulation for the feet of the user, thus assuring him better protection against the cold.

BRIEF DESCRIPTION OF THE DRAWINGS

The invention and the advantages which it provides will, however, be better understood from the embodiments which are disclosed below by way of illustration and not of limitation and which are shown in the accompanying drawings, in which:

FIG. 1 shows, in perspective, a traditional crampon which is not equipped with the safety device of the present invention and which is described to assure a better understanding of the safety device of the invention;

FIG. 2 shows in top view a first embodiment of the device in accordance with the invention;

FIG. 3 shows this same first embodiment along the section line aa of FIG. 2;

FIG. 4 shows this same first embodiment along the section line bb;

FIG. 5 shows in perspective in partial view one embodiment of means for fastening the safety device below the frame of a conventional crampon;

FIG. 6 shows, in top view, a second embodiment of a crampon equipped with a safety device in accordance with the invention;

FIG. 7 shows this same second embodiment along the section line cc of FIG. 6;

FIG. 8 shows this same second embodiment of the invention along the section line dd of FIG. 6;

FIG. 9 shows a variant of this second embodiment along a section similar to the section line dd of FIG. 6;

FIG. 10 shows a longitudinal section through a third embodiment of the crampon;

DETAILED DESCRIPTION OF THE INVENTION

Figure 11:
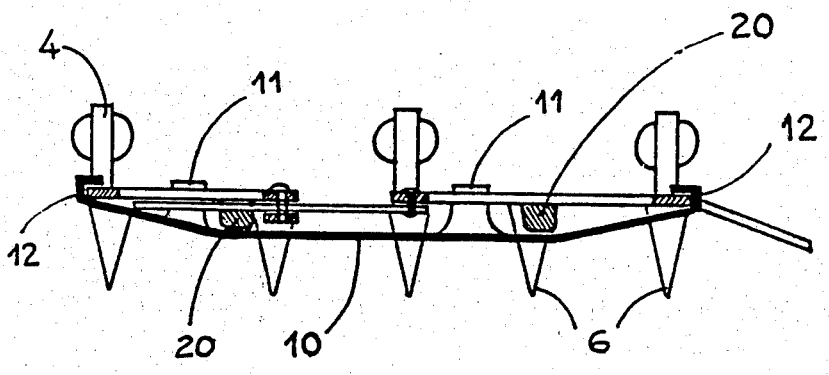
FIG. 11 shows a fourth embodiment of the crampon in longitudinal section.

FIG. 1 shows, in perspective, a traditional crampon not equipped with a device in accordance with the invention. Such a crampon consists, essentially, of a metal frame formed of two unit frames 1, 2. The unit frame 1 receives the front of the boot while the unit frame 2 receives the heel. These two unit frames are connected by a length adjustment system 3 which makes it possible to adapt the crampon to the toe of the boot on which it is desired to use it. Each unit frame 1, 2 is provided, towards its top, with attachment lugs 4 serving for the lateral immobilization of the boot and having rings 5 through which there pass the belts or straps which secure the crampon below the sole of the boot. Downward directed spikes 6, the number of which varies in accordance with the model of crampon, are provided on the unit frames 1, 2 and are intended to implant themselves in the snow or ice. Furthermore, spikes 7 arranged at the front of the crampon are used for progression over very steep slopes, the mountain climber facing the slopes to be climbed. In the following description, the invention will be described as applied more particularly to this type of crampon, but it is clear that this is not limiting and that it is also applicable to any other type of crampon, for instance to those having articulated frames in order to obtain a width adjustment as a function of the boot, or those having other means for fastening them to the boot, for instance, systems of peripheral cables and levers.

The crampon safety device in accordance with the invention is in the form of a sheet 10, arranged below the frame 1, 2 of the crampon and extending at least between the side spikes 6 and advantageously over the entire length of the crampon, forming a screen between the snow and the metal parts of the crampon which are in contact with the sole of the boot. Thus if one looks from below at a crampon equipped with such a device one will see only the spikes 6, all the rest of the crampon being concealed by the sheet 10. In accordance with the invention, the sheet 10 is capable, either by its own structure or due to fastening means for attaching it to the crampon, of deforming or moving slightly in an elastic manner in all directions (length, width and thickness) when the user walks.

In accordance with a first embodiment, shown in FIGS. 2, 3, 4 and 5, the sheet 10 which is located below the frame 1,2 of the crampon consists of a material which is elastic in itself, such as for instance a sheet of a material known under the name of "neoprene", having a thickness of about 2 mm. This sheet 10 is attached to the crampon by means of a plurality of side hooks 11 and end hooks 12. As the constituent material of this sheet 10 is deformable, it is possible to stretch it slightly in order to put in in place, which is to be done before the mountain climber places his boot in the crampon. As can be seen from FIG. 2, the sheet 10 occupies the space present between the teeth 6. FIG. 3 makes it possible more clearly to note the location of the sheet below the crampon, between the spikes 6, 7 of the crampon. FIGS. 4 and 5 show the manner in which this sheet 10 is fastened to the frame of the crampon, the attachment being obtained in this embodiment by means of side hooks 11 fastened, for instance, by riveting to the sheet 10. In this embodiment, the hooks 11 fit onto the periphery of the frame 1, 2 and hold the sheet firmly to the latter. Of course, the attachment of the hooks 11 to the sheet 10 could be effected by any means other than riveting, for instance by bonding.

FIGS. 6, 7 and 8 illustrate a second embodiment, in which the sheet 10 located below the crampon is attached to the latter by elastic lugs 13, which may either be attached to the sheet 10 or be part of the sheet itself and therefore formed of the same material as the latter. The installation is easily effected by first placing the sheet 10 on the lugs 13 on one side and then those on the other side. In this embodiment, either the sheet 10 is traversed by the spikes 6, 7, whether or not orifices for the passage of the spikes are made in advance, or the sheet 10 surrounds the spikes 6, 7 at the places where the sheet is present. FIG. 9 illustrates a variant of this second embodiment in which the elastic lugs described in FIGS. 6, 7 and 8 are replaced by side bands 14 attached to the sheet 10 or forming an integral part thereof, said side bands 14 surrounding the boot 8, and the assembly being immobilized by means of a hook 15 arranged on one of the side bands. Other known means of hooking can, of course, replace the hook 15.

In accordance with a third embodiment, shown diagrammatically in FIG. 10, the sheet 10 also consists of an elastic, resistant material. As previously described in connection with the first embodiment, this sheet 10 has a number of side hooks which fit over the edges of the frames 1,2. The rear end of the sheet is fastened to the rear of the frame of the crampon by a hook 18 similar to the side hooks 11. The front end of the sheet, the width of which is reduced at this place so that it can pass between the two front spikes 7 of the crampon, surrounds the front portion of the boot 8, the sole 9 of which rests on the crampon. For attachment, the side hooks 11 and the hook 18 are placed below the crampon before the boot 8 is put in place. After the boot has been placed in the crampon, the mountain climber grasps the front end 16 of the sheet and pulls it so as to place hook 7 in the laces 19 of the boot.

FIG. 11 illustrates a fourth embodiment, in which the embodiment of FIG. 10 is fastened, as in the first embodiment, by side hooks 11 and end hooks 12. In this variant, the sheet 10 rests on at least one stop 20 which is rigidly connected to the frame of the crampon and takes up substantially the width thereof. This embodiment makes it possible to promote the ejection of the snow even more, due to the elasticity of the material of the sheet. In fact, upon each step, under the weight of the climber, the snow will compress the sheet 10, thus tending to crush it against the sole of the boot. When the climber raises his foot, the sheet 10, resting against the stops 20, will, due to its elasticity, tend to return to its original position as shown in FIG. 11 and will eject the snow present between the spikes 6. In accordance with a variant of this embodiment (not shown), the stops 20 may be rigidly attached to the sheet 10 and not to the crampon itself. Of course, the stops 20 may be made shorter or longer than those shown in FIG. 11 or the shape and number of such stops can be changed without thereby going beyond the scope of the invention.

The invention is, of course, not limited to the embodiments previously described. In particular, it is possible to fasten the sheet 10 below the frame of the crampon by any other means besides side hooks, for instance by gluing, vulcanizing, riveting, etc., the only precaution to be taken being that either as a result of the structure of the sheet or of the manner of attachment, the sheet can move elastically when the user walks. It can also be contemplated to fasten the sheet to the frame of the crampon by mounting said sheet on a semi-rigid or rigid support which then is itself fastened to the crampon by any known means, such as, rivets, nails, or glue.

Finally, different types of material can be used to form the sheet which is to be fitted to the crampon in accordance with the invention. One can, for instance, use a very strong synthetic rubber such as neoprene which has excellent tear strength and which furthermore retains substantially constant hardness even at low temperatures. The thickness of such a sheet may vary between one and several millimeters, depending on the strength desired. The tension imparted to the sheet at the time that it is put in place between the hooks may make it possible to accentuate the rejection of the snow between the spikes of the crampon and to a certain extent favor the holding of said sheet on the crampon.

It may also be contemplated to use as material for the sheet a non-elastic non-deformable material, for instance a fabric or a strip of plastic material, the important thing being that in accordance with the invention the attachment of said sheet to the crampon is effected by means of deformable or elastic elements which permit the displacement of the sheet when the user walks.

The safety device in accordance with the invention can be used in all cases in which a mountain climber desires a high degree of security as he travels over snow-covered slopes. It is possible to adapt it to all types of existing crampons and its use is therefore universal. The invention is therefore particularly important for improving the safety of mountain climbers.

This device has a very large number of advantages, among which the following may be mentioned:

when the sheet used is an elastic sheet it is possible to use it for several different shoe spikings, it is of simple design, economical, and is of very low weight, which is particularly desired by mountain climbers, it can be manufactured of very strong materials which are at present known for other applications.

Finally, it can be adapted to any new design of crampon such as, for instance, that in which the two metal frames connected by a length-adjustment system are replaced by a single rigid or semi-flexible plate. In this case, the sheet rests on said plate and plays the same role as indicated above, preventing the accumulation of snow between the teeth of the crampon.

Finally, while in the present specification the device in accordance with the invention has been described with the use of a sheet made in a single piece, it could be contemplated, without going beyond the scope of the invention, to make such a sheet from individual elements juxtaposed parallel to each other.

What is claimed is:

1. A safety device for fitting onto crampons such as those used by mountain climbers for traveling over snow-covered or ice-covered slopes, said device comprising; a sheet disposed a slight distance below the frame of the crampon, extending at least between the spikes on the crampon, forming a screen between the snow and the metal parts of said crampon for contacting the sole of the boot, said sheet being capable of elastically deforming or moving slightly in elastic fashion in all dimensions when a user walks.

2. A safety device for crampons according to claim 1, wherein the sheet is to be traversed by the spikes and protrudes laterally beyond said spikes.

3. A safety device according to claim 1, wherein the sheet is formed of a material which is deformable in itself, such as an elastomer-base material.

4. A safety device according to claim 1, wherein the sheet is formed of a material which is non-deformable in itself, and includes means for elastically connecting it to the crampon or the boot by means of elements which assure its displacement and/or its deformation.

5. A safety device according to any of claims 1 through 4, characterized by the fact that on its periphery it has hooking means intended for fastening to the crampon or boot.

6. A safety device according to claim 5, wherein said hooking means are elastic lugs forming an integral part of the sheet for fastening to the periphery of the frame of the crampon.

7. A safety device according to claim 5, wherein the sheet is provided with side portions intended to pass over the boot and to be held in place by hooks or lacing.

8. A device according to any of claims 1 through 4, wherein the sheet rests on stops which are to be rigidly secured to the frame of the crampon or the sheet, the said stops for holding the sheet being spaced from the surface of the frame and increasing the snow-ejecting effect as a result of the elasticity of the material.

9. A safety device according to any of claims 1 through 4, wherein the sheet is fastened on a support consisting of a rigid or semi-rigid material, said support being adapted for being fastened below the frame of the crampon.

10. A safety device according to claim 5, wherein the rear end of the sheet has at least one hooking means, the front end extending so as to go between the two front spikes of the crampon and having at least one hooking means for fastening on the top of the boot.

11. A device according to any of claims 1 through 4, wherein the sheet is formed of a very strong elastic material having a thickness of between 1 and a few millimeters.

12. A safety device for ejecting snow which has accumulated between the spikes of a crampon, such as a crampon for attachment to the boots of mountain climbers, said safety device comprising;

a sheet positioned a slight distance below the frame of the crampon and extending at least between the spikes of the crampon, such that with each step the sheet, under the weight of the user, is compressed by snow accumulating between the spikes and, as the crampon is raised off the snow, the sheet resiliently springs back ejecting snow accumulated between the spikes.

* * * * *